US005375797A

United States Patent [19]

Willow

[11] Patent Number: 5,375,797

[45] Date of Patent: Dec. 27, 1994

[54] COMPOUND GEOMETRY RAIL SWITCH

[76] Inventor: Robert E. Willow, 118 Warwick Dr., #70, Benicia, Calif. 94510

[21] Appl. No.: 122,660

[22] Filed: Sep. 17, 1993

[51] Int. Cl.[5] ..... E01B 7/00

[52] U.S. Cl. ..... 246/415 R; 246/435 R

[58] Field of Search ..... 246/415 R, 435 R, 429

[56] References Cited

U.S. PATENT DOCUMENTS 941,089 11/1909 McCalib ..... 246/415 R 3,977,635 8/1976 Pirker et al. ..... 246/415 R X

FOREIGN PATENT DOCUMENTS 1303643 4/1987 U.S.S.R. ..... 246/435 R

*Primary Examiner*—Douglas C. Butler

*Assistant Examiner*—S. Joseph Morano

*Attorney, Agent, or Firm*—Harris Zimmerman

[57] ABSTRACT

An improved geometry for a split switch rail turnout a compound point rail leading to a curved closure rail that is linear and tangent through the switch frog. The switch point rail includes a proximal portion curved in the same radius as the closure rail, and a distal end portion that is linear and tangent to the proximal portion. The linear distal end portion of the point rail provides an entry angle of the switch point that is the same as the angle of attack of a wheel truck encountering the turnout, and also provides the shortest possible switch point length and the greatest possible radius of curvature of the closure rail. The angle of attack and the curvature of the closure rail can be optimized to produce a split switch turnout that permits high speed through the turnout while minimizing wear and maintenance costs.

5 Claims, 4 Drawing Sheets

No. 20 TURNOUT/COMPOUND POINT GEOMETRY

No. 20 TURNOUT/COMPOUND POINT GEOMETRY

EXTENDED TURNOUT/COMPOUND POINT GEOMETRY

COMPOUND GEOMETRY RAIL SWITCH

BACKGROUND OF THE INVENTION

The present invention relates to rail switches, and more particularly to optimizing the geometry of rail switches with regard to high speed rolling stock, switch wear and maintenance, and passenger comfort.

For more than 150 years the method of switching railroad stock from one track to a departing track has been through the use of split switch turnouts. Split switch turnouts are composed of a pair of switch points to direct the rolling stock away from its original course, curved closure rails to direct them to the new course and frogs which allow outside wheels to pass over or through crossing rails. The switch points were fabricated from straight pieces of standard rail and are now called straight split switches. These straight split switches were economical and performed well enough on lightly used, slow speed tracks and still constitute the majority of switches in use today.

Approximately 40 years ago a need was perceived for a switch which would furnish higher safe speed and comfort. The result was the adoption of curved point switches. The radii of these curved points were generally greater than the closure curves and acted as transition or easement curves. They also reduced the switch point entry angle by about half. This has improved things greatly and these curved point split switches, in recent years, have generally been the choice in heavy rail and transit rail design when maximum speed and comfort was sought. This type of turnout has been used in the construction of recent light rail transit systems.

Still, the curved switch points were not tangent to the stock rail and the wheel flange encountering the switch point and being abruptly diverted laterally to a new direction produced two bothersome problems. The major one for heavy freight haulers was the heavy wear experienced by the switch points and the resulting high maintenance costs, as well as limitations of speed and scheduling. For transit operators the limitations on speed and scheduling are also important, but even more important was the sudden and in some cases severe lateral acceleration experienced by passengers.

Rail designers in the United States turned to European rail technology to solve these two problems, spurred by two developments in the United States. One was the decision taken by AMTRAK to initiate much higher speed train service, and the other was a move toward alternatives to heavy rail transit systems such as BART and MARTA. Europe and Japan have developed very high speed trains, such as the Bullet Train and the TGV, and European light rail systems are look to as a source of new rail technology. Indeed, many concepts of European rail practice have been or are being accepted in the United States.

The "new" technologies are not really new. They have been in use in Europe for some time, and they are not really new to the United States, either. For example, swing nose or movable point frogs have been used in the U.S.A., mostly in transit systems, and tangential geometry has been used in crane rail and transit systems. From the perspective of a light rail designer, many of the characteristics of European turnouts are expensive and add very little or nothing to the quality of the ride or rated speed of the AREA No. 20 turnouts now in use.

The one characteristic recognized as an improvement over an AREA standard turnout is the use of tangential geometry. However, claims of significantly higher speeds are not supported by experience. The basis of these claims is the reduction of the switch's point angle from 0°27′ to 0° on a No. 20 turnout. This factor significantly improves the ride through the switch and in most regards the tangential geometry switch is superior to the AREA switch. However, when considering the physical relationships of the wheel flange encountering the switch point, it is apparent that a 0° switch point angle is not necessary nor is it desirable.

The wheel flange rides from ⅜ inch to ¾ inch inside the gauge line and does not encounter the switch point until it is well past the point of the switch. At this point, which we term the effective point of entry, a tangential geometry switch has developed an effective entry angle of 0°21′ to 0°27′. In designing a rail switch for maximum comfort and speed it is the effective entry angle that should be minimized and the switch curve radius maximized.

In recognition of this fact the secant geometry switch has been propose. It is similar to the AREA geometry except that the radius of the point and the closure curve are the same. To compare the two geometries, the following table indicates the parameters of a standard AREA No. 20 switch, compared to the best tangential geometry switch and secant geometry switch that could be produced within the same lead as the No. 20 switch.

| | AREA | Tangential | Secant |
|---|---|---|---|
| Point Angle | 0° 27′ 19″ | 0° 0′ 0″ | 0° 04′ 37″ |
| Entry Angle | 0° 32′ 17″ | 0° 20′ 05″ | 0° 20′ 05″ |
| Closure Radius | 3333.36 | 2444.22 | 2581.37 |
| Point length | 39′ 0″ | 50′ 6⅜″ | 48′ 6″ |
| Lead | 156′ 0½″ | 156′ 0½″ | 156′ O½″ |

While the tangential geometry switch has a lower entry angle than the AREA switch, it has three major drawbacks. The point is longer, the closure radius is much sharper, and the point is knife-edge and therefore weak and vulnerable. The secant switch, given the same lead length, is superior to the tangential geometry switch. Although the entry angle is the same, the point is shorter, the closure radius is larger (though still far smaller than the AREA geometry), and the point is less vulnerable.

SUMMARY OF THE PRESENT INVENTION

The present invention generally comprises an improved rail turnout featuring a novel geometry that optimized the quality of the ride, wear and maintenance, and cost and availability. The geometry of the rail switch, termed herein a compound point switch, is based on the observation that the first few feet of the prior art switches have very little function and might as well be straight. This change produces a switch point in which the first few feet are straight and the rest is curved in the same radius as the closure curve. Using the same lead length parameter as above, the compound switch of the invention has the following characteristics.

| | Compound |
|---|---|
| Point Angle | 0° 20′ 05″ |
| Entry Angle | 0° 20′ 05″ |
| Closure Radius | 2810.3 |

-continued

| | Compound |
|---|---|
| Point length | 45' 10¼" |
| Lead | 156' 0½" |

Clearly the compound switch is as superior to the secant geometry as the secant geometry is to the tangential geometry switch. The entry angle is the same, the radius is increased significantly, and the point length is reduced in comparison to the secant geometry.

Furthermore, the superiority of the compound geometry switch is accentuated when longer leads are used. Longer leads will enhance the efficiency of all types of switches, but the tangential and secant switches reach an asymptotic limit, which is also the point at which they become identical. This limit, given the same frog tangent, is 178'-9" and at that point the entry angle is 0° 17", the radius is 3353' and the point length is 59'-1⅛". This is as far as the tangent and secant geometries can be extended.

The compound geometry switch, however, can be pushed to an infinite length, and the real limit is defined by physical and fiscal constraints. Considering all factors, a compound geometry switch can be designed having an entry angle of 0°11', a radius of 3332 feet, a switch point length of 59 feet, 10 7/16 inches, and a lead of 179 feet, 3 9/16 inches. This layout allows a comfortable transition by light rail cars at 50 mph, and cars with improved suspension could transit the switch at 55 mph. Freight cars could travel through this switch at 60 mph. Other layouts can be designed using the compound geometry, and formats can be standardized by appropriate institutions. The relationships described herein hold true for all turnout angles, lengths, and rail gauges.

DESCRIPTION OF THE PREFERRED EMBODIMENT

Figure 1:
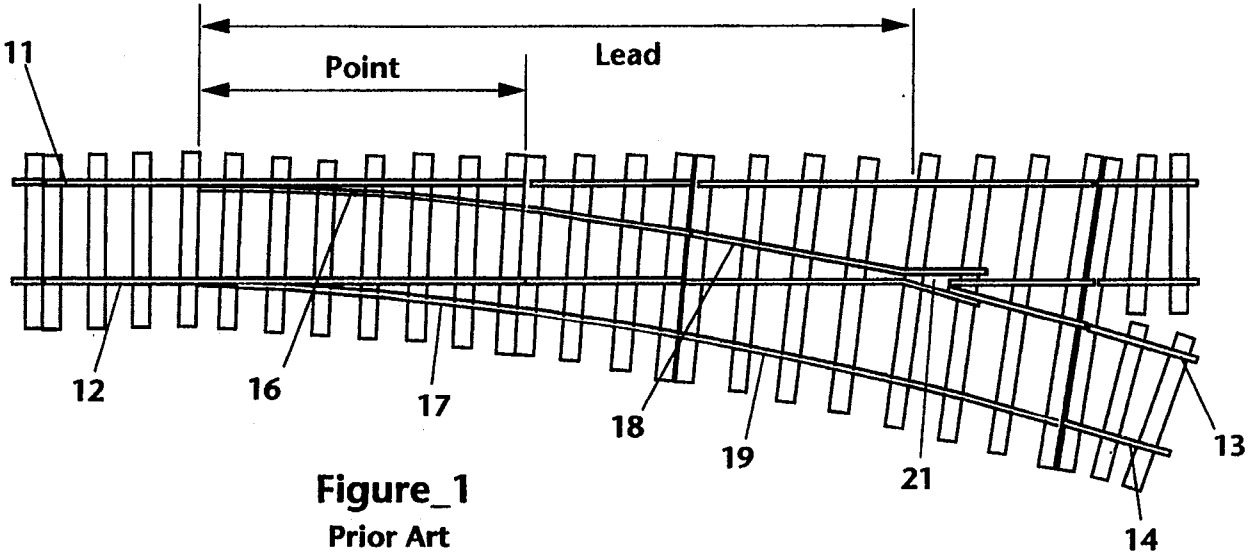
Figure 1 Prior Art
FIG. 1 is a plan view of a typical prior art rail switch, showing the major features and defined parameters.

The present invention generally comprises an improved rail turnout featuring a novel geometry that optimized the quality of the ride, wear and maintenance, and cost and availability. Before describing the invention, termed a compound point turnout, it is first necessary to review comparable prior art rail turnout configurations so that the subtle but significant distinctions and advantages of the invention may be appreciated. With regard to FIG. 1, a typical prior art rail turnout (switch) includes a pair of entrance rails 11 and 12 extending parallel at a standard rail gauge spacing, and a pair of parallel turnout rails 13 and 14 disposed obliquely to the entrance rails. A pair of switch point 16 and 17 are disposed to direct a rail vehicle onto a pair of curved closure rails 18 and 19, respectively, and a frog 21 is interposed at the intersection of rail sections 12, 13, and 18 to permit the rail wheel to make the transition from rails 18 to 13 across rail 12. The point length of the turnout is the distance from the pivots of the switch points to the distal ends thereof, and the lead length is the distance from the distal ends of the switch points to the frog.

Figure 3:
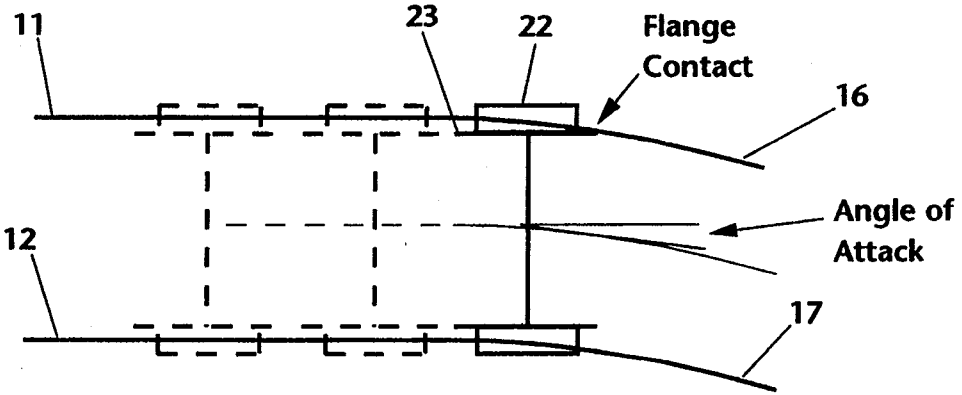
FIG. 3 is a diagrammatic depiction of the angle of attack of a rail vehicle entering a rail switch.

With regard to FIG. 3, a wheel truck 22 must make a transition from the straight entrance rails 11 and 12 to the switch points 16 and 17. The wheel flange 23 rides from ⅜ inch to ¾ inch inside the gauge line and does not encounter the switch point rail 16 until it is well past the distal point of the switch. The wheel truck continues its generally linear motion until the flange 23 strikes the switch point rail. At the instant of contact, the flange 23 and the point rail define an angle of attack, and the angle of attack determines the lateral acceleration applied to the rail vehicle, and thus the comfort of the transition for passengers, and the wear factor created by the turnout. The angle of attack is also a limiting factor for the maximum safe speed through the turnout. Although the switch points and the straight rail sections extend at some predetermined angle or may blend in a tangent relationship, the actual angle of attack generally differs in accordance with the physical relationships of the wheel flange and the switch point rail.

Figure 2:
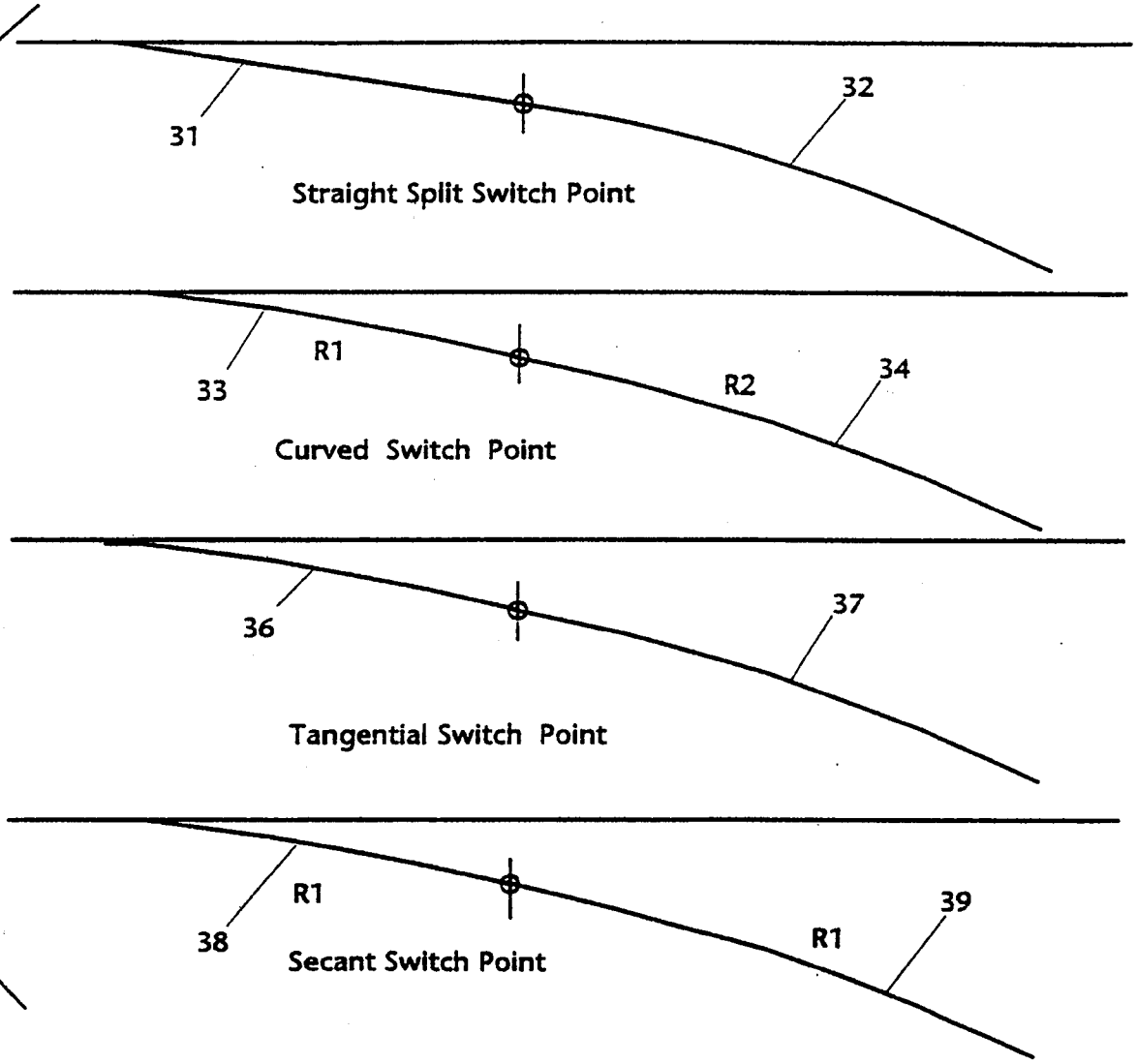
Figure 2 Prior Art
FIG. 2 is a diagrammatic depiction of major prior art rail switches, emphasizing the differing switch point configurations.

The only turnout layout in which the angle of attack is identical to the angle of the switch point rail is the straight split switch, as shown in FIG. 2. In a straight split switch, the switch point rail 31 is linear and extends tangent to the end of the curved closure rail 32. In a standard AREA No. 20 layout, the switch rail 31 extends at an angle of 0°58'30", and this is also the angle of attack for the wheel truck encountering the turnout. This is a relatively large attack angle, limiting the maximum safe speed through the turnout and causing an uncomfortable lateral acceleration for passengers.

For discussion purposes, a No. 20 turnout will continue to be used as a basis for comparison. However, the relationships described herein hold true for all turnout angles, lengths, and rail gauges.

To reduce the large attack angle of straight split switches, the curved switch point was introduced. As shown in FIG. 2, a switch point employs a curved rail 33 to smooth the transition to the curved closure rail 34. The point rail 33 generally has a radius of curvature greater than the closure rail 34. Although in the standard No. 20 curved switch layout the point angle to the entrance rail is 0°27'19", the actual angle of attack is 0°32'17" at a 0.5 inch separation of the point rail 33 from the entrance rail, which is the location where the wheel flange is expected to strike the switch point rail 33. The angle of attack is reduced from the straight split switch, but remains rather high and limiting in turnout speed. etc.

To further reduce the angle of attack of curved split switches, the tangential switch point has been introduced. Referring to FIG. 2, the switch point rail 36 extends tangentially to the entrance rail, and has a radius of curvature generally equal to the radius of curvature of the closure rail 37. Thus the switch point angle is 0°00'00"; however, the angle of attack for a standard No. 20 tangential switch point layout is 0°20'05" at 0.5 inch separation of the switch point rail and the entrance rail. As noted above, the tangent relationship of the distal end of the switch point requires that the end have a thin, knife-like edge which is weak and subject to wear and damage. Moreover, the first several feet of the point rail typically has no effect in redirecting a rail vehicle, due to the fact that the wheel flange does not contact that distal end portion.

Further evolution of turnouts has resulted in the secant switch point, also shown in FIG. 2. The secant switch point rail 38 is provided with a radius of curvature generally the same as the curved closure rail 39, but the switch point angle is greater than zero (i.e., 0°04'36" for a No. 20 secant switch layout) to increase the thickness and strength of the distal end of the switch point rail. The angle of attack is the same as the tangential switch point layout - 0°20'05". Here again, however, the first several feet of the point rail typically have no effect in redirecting a rail vehicle, due to the fact that the wheel flange does not contact the distal end portion of the point rail.

The present invention comprises a rail turnout geometry that improves upon the prior art rail turnout geometries described above. With regard to FIG. 4, the invention comprises a compound point rail turnout in which the switch point rails combine the best attributes of curved, secant, and tangential geometries. The compound point rail turnout includes a pair of pivotable point rails 41 and a pair of immobile curved closure rails 42. Each closure rail 42 includes a proximal end portion 43 which is linear and tangent to the curved main portion of the closure rail, the portion 43 extending into the switch frog 44. The point rails 41 each includes a curved proximal portion 47 having a radius of curvature generally the same as the closure rail 42, and a distal portion 46 that is linear and tangent to the portion 47. The position of the junction of the portions 46 and 47 of each point rail 41 is determined to be the attack point, which is the position where the wheel flange first strikes the point rail, and the linear portion 46 extends at an angle to the entrance rail. Thus, for example, in a No. 20 turnout adapted to compound point geometry, the switch point angle is 0°20'05", and the angle of attack is likewise 0°20'05". The point length is 45'-1¾", the radius of the closure rail is 2810.295 feet, and the lead length is the standard 156'½".

The linear end portion 46 provides a more robust distal end to the point rail and eliminates the expense of creating a curved end section that achieves no purpose. The angle of attack is identical to a tangential or secant geometry No. 20 rail turnout. Also, the compound geometry of the invention provides the shortest possible switch point length, far shorter than a comparable tangential layout while providing the same angle of attack.

Figure 6:
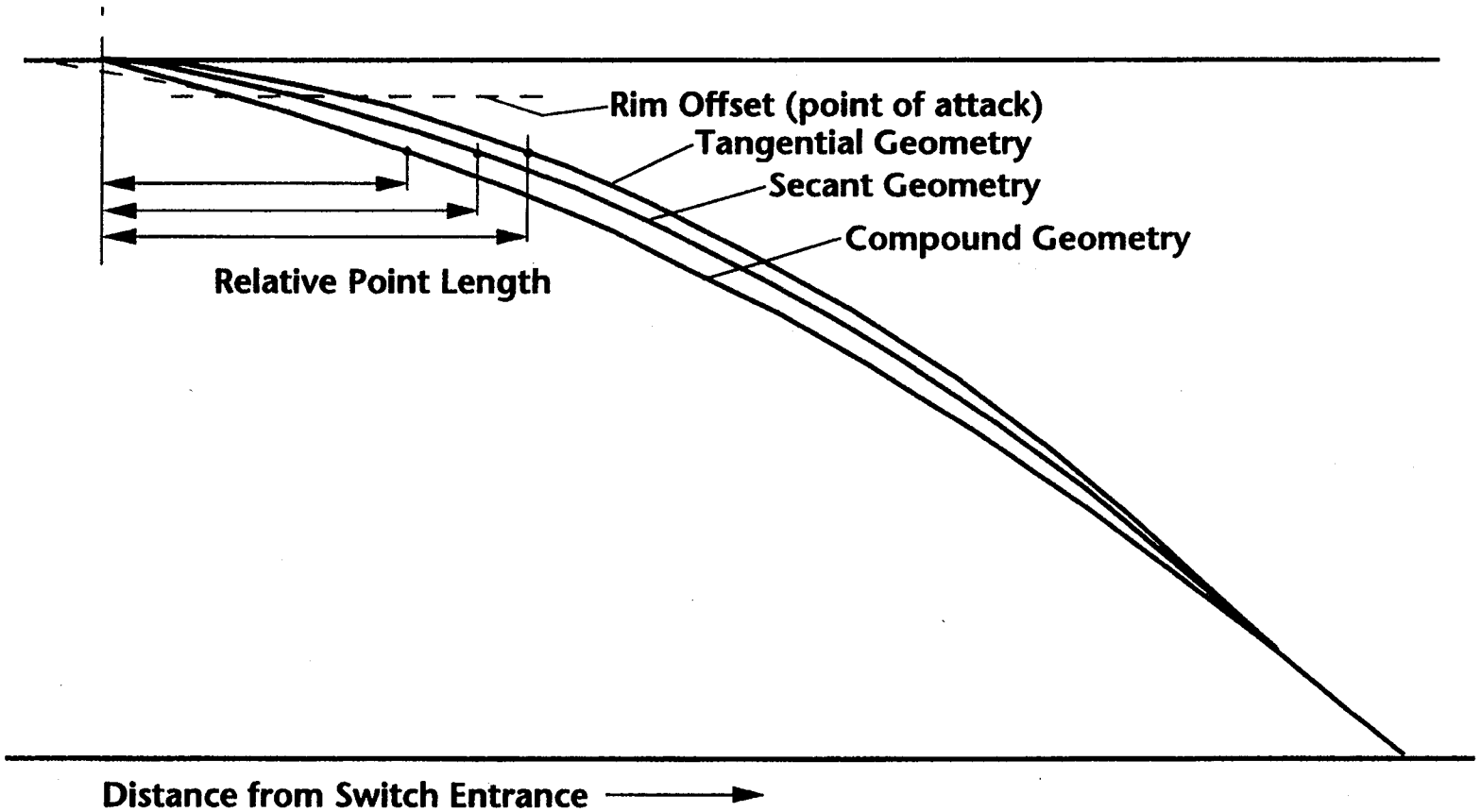
FIG. 6 is a graphic depiction of tangential and secant rail switches of the prior art compared with the compound geometry rail switch of the present invention.

FIG. 6 depicts a graphic comparison of the compound geometry of the invention to prior art secant and tangential geometries, and indicates that the radius of curvature of the closure rail is greatest and the relative point length is least for the compound geometry.

Figure 4:
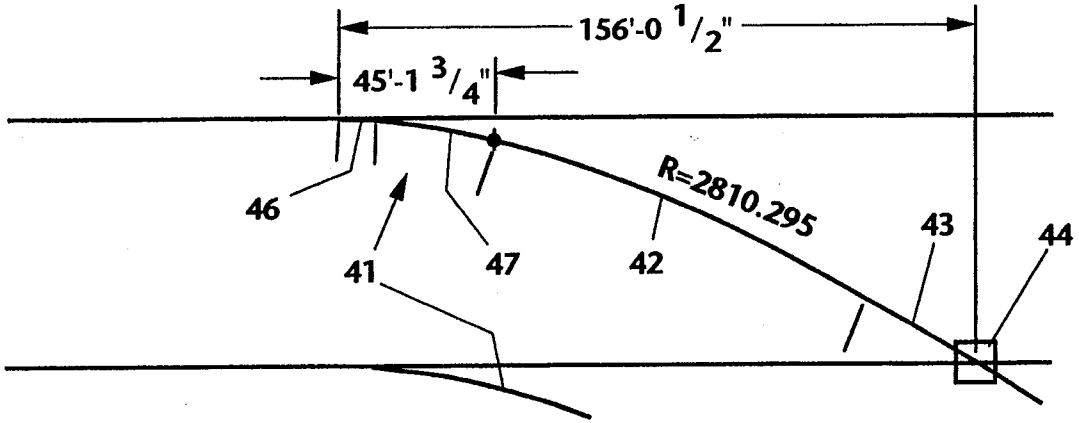
FIG. 4 is a diagrammatic depiction of a No. 20 turnout fabricated in accordance with the present invention.
Figure 5:
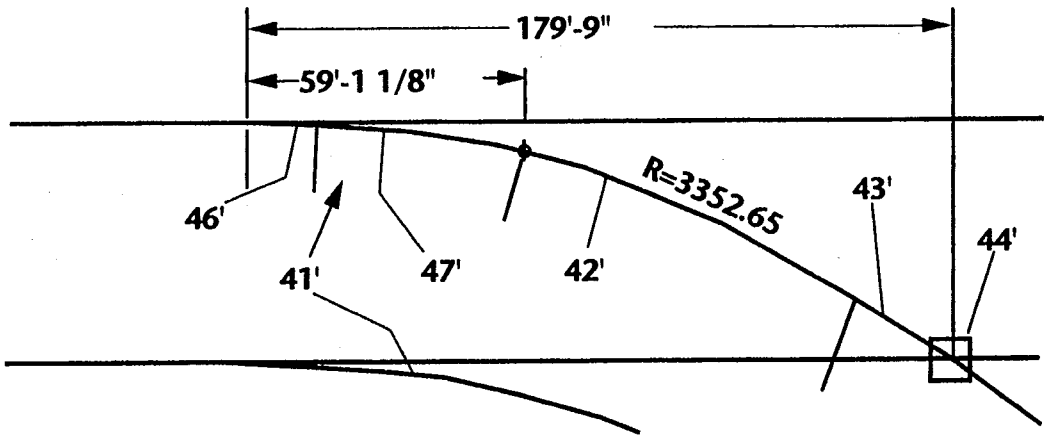
FIG. 5 is a diagrammatic depiction of an extended length No. 20 turnout fabricated in accordance with the present invention.

Although the compound point geometry of the invention provides an improved, optimized rail turnout in the AREA No. 20 format, the advantages over prior art layouts are accentuated in a longer lead format. Another example is shown in FIG. 5, in which correspondence to components of FIG. 4 is indicated by the addition of a prime (') designation to the reference numeral. The compound geometry may be optimized at a lead length of approximately 179 feet, which would provide an entry angle (and angle of attack) of approximately 0°11'. This small angle permits high speed transition through the turnout, and would suffice for modern high speed rail.

| | No. 20 Compound | Extended Compound |
|---|---|---|
| Point Angle | 0° 20' 05" | 0° 11' 00" |
| Entry Angle | 0° 20' 05" | 0° 11' 00" |
| Closure Radius | 2810.3 feet | 3332 feet |
| Point length | 45' 10¼" | 59' 10½" |
| Lead | 156' 0½" | 179' 3⅝" |

The compound switch point geometry of the present invention provides many advantages over prior art turnout geometries, which are summarized as follows:

1) The least possible departure angle from the entrance rail;

2) The largest closure curve radius possible;

3) The shortest overall turnout length possible consistent with the large closure curve radius and small departure angle;

4) The shortest switch point possible;

5) The most robust point rail end, resulting in low wear and maintenance:

6) The cheapest fabrication costs for the high performance obtained:

7) The cheapest maintenance costs for a high performance turnout.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

I claim:

1. A split switch rail turnout, including;

a pair of closure rails, each including a curved main portion and a first proximal end portion extending integrally and tangentially to said curved main portion;

a pair of point rails selectively pivotable to redirect a rail vehicle from a pair of entrance rails to said closure rails, each of said point rails including a second proximal end portion extending contiguously to a distal end of a respective curved main portion of a respective closure rail, said second proximal end portion being curved;

each of said point rails further including a linear distal end portion, said linear distal end portion extending integrally and tangentially to said second proximal end portion;

said linear distal end portion of each of said point rails defining a switch point angle with a respective entrance rail;

said switch point angle having a non-zero value.

2. The split switch rail turnout of claim 1, wherein said curved main portion of each of said closure rails has a first radius of curvature, said second proximal end portion has a second radius of curvature, and said first and second radii of curvature are substantially the same.

3. The split switch rail turnout of claim 1, wherein said rail turnout further includes a switch frog disposed at the intersection of one entrance rail and one of said closure rails, and further including a second linear end portion of said one of said closure rails extending through said switch frog.

4. A split switch rail turnout, including;

a pair of closure rails, each including a curved main portion and a first proximal end portion extending integrally and tangentially to said curved main portion;

a pair of point rails selectively pivotable to redirect a rail vehicle from a pair of entrance rails to said closure rails, each of said point rails including a second proximal end portion extending contiguously to a distal end of a respective curved main portion of a respective closure rail, said second proximal end portion being curved;

each of said point rails further including a linear distal end portion, said linear distal end portion extending integrally and tangentially to said second proximal end portion;

said linear distal end portion of each of said point rails defining a switch point angle with a respective entrance rail;

wherein said switch point angle is non-tangential and greater than 0°0′00″.

5. A split switch rail turnout, including;

a pair of closure rails, each including a curved main portion and a first proximal end portion extending integrally and tangentially to said curved main portion;

a pair of point rails selectively pivotable to redirect a rail vehicle from a pair of entrance rails to said closure rails, each of said point rails including a second proximal end portion extending contiguously to a distal end of a respective curved main portion of a respective closure rail, said second proximal end portion being curved;

each of said point rails further including a linear distal end portion, said linear distal end portion extending integrally and tangentially to said second proximal end portion;

said linear distal end portion of each of said point rails defining a switch point angle with a respective entrance rail;

each of said point rails including an attack point comprising the expected impact position of a wheel flange of a rail vehicle, said attack point coinciding with the conjunction of said second proximal end portion and said linear distal end portion.

* * * * *